US012600541B2

(12) United States Patent
Kriesche et al.

(10) Patent No.: US 12,600,541 B2
(45) Date of Patent: Apr. 14, 2026

(54) BLEND THROUGH CUP LID

(71) Applicant: Smoodi, Inc., Boston, MA (US)

(72) Inventors: Pascal Kriesche, Boston, MA (US); Morgan Abraham, Boston, MA (US)

(73) Assignee: SMOODI, INC., Boston, MA (US)

( * ) Notice: Subject to any disclaimer, the term of this patent is extended or adjusted under 35 U.S.C. 154(b) by 956 days.

(21) Appl. No.: 17/689,763

(22) Filed: Mar. 8, 2022

(65) Prior Publication Data

US 2022/0281661 A1 Sep. 8, 2022

Related U.S. Application Data

(60) Provisional application No. 63/158,168, filed on Mar. 8, 2021.

(51) Int. Cl.

| | |
|---|---|
| ***B65D 51/32*** | (2006.01) |
| ***B65D 43/02*** | (2006.01) |
| ***B65D 51/00*** | (2006.01) |

(52) U.S. Cl.

CPC ..... *B65D 51/32* (2013.01); *B65D 43/0212* (2013.01); *B65D 51/002* (2013.01); *B65D 2231/022* (2013.01); *B65D 2543/00537* (2013.01); *B65D 2543/0062* (2013.01)

(58) Field of Classification Search

CPC .... B01F 27/806; B01F 2101/14; B65D 51/32; B65D 2232/022; B65D 2231/022

See application file for complete search history.

(56) References Cited

U.S. PATENT DOCUMENTS

| | | | | |
|---|---|---|---|---|
| 1,496,611 | A | 6/1924 | Siegel | |
| 2,765,832 | A * | 10/1956 | Tupper | B29C 66/71 220/675 |
| 4,881,656 | A * | 11/1989 | Chumley | B26F 1/22 215/256 |
| 8,434,378 | B2 | 5/2013 | Brinker | |
| 8,453,865 | B1 * | 6/2013 | Bobier | A47G 21/18 215/388 |
| 10,293,989 | B2 * | 5/2019 | Shields | B65D 51/002 |

(Continued)

FOREIGN PATENT DOCUMENTS

| | | |
|---|---|---|
| DE | 202015000185 U1 | 2/2015 |
| EP | 2151179 A1 | 2/2010 |

(Continued)

OTHER PUBLICATIONS

English translation of JPH046618Y2, Feb. 24, 1992, obtained Jan. 28, 2025 from <https://patents.google.com/ > (Year: 2025).*

(Continued)

*Primary Examiner* — Claire X Wang
*Assistant Examiner* — Patrick M Mccarty
(74) *Attorney, Agent, or Firm* — Lewis Rice LLC

(57) ABSTRACT

A lid, a disposable cup with the lid, and a blending machine for use with the lid and cup which is particularly well-suited for use in a self-service blending environment where material is initially provided in unblended form in the disposable cup, is blended in the disposable cup, and the disposable cup is used by the end user during consumption of the material. The lid is designed to allow for a blade assembly of the blending machine to pass through the lid and into the cup without it having to be removed.

19 Claims, 16 Drawing Sheets

(56) References Cited

U.S. PATENT DOCUMENTS

| | | | | |
|---|---|---|---|---|
| 2004/0084452 | A1* | 5/2004 | Hsieh | B65D 43/0229 220/259.3 |
| 2006/0039235 | A1* | 2/2006 | McGill | A47J 43/046 366/279 |
| 2006/0278641 | A1* | 12/2006 | Ziegler | A47G 23/0233 220/780 |
| 2011/0204057 | A1* | 8/2011 | Hayashi | B65D 47/36 220/277 |
| 2011/0247435 | A1* | 10/2011 | Brinker | B01F 27/806 73/864.01 |
| 2016/0255994 | A1 | 9/2016 | Walker | |
| 2017/0157629 | A1* | 6/2017 | Toh | B05B 11/026 |
| 2020/0188867 | A1* | 6/2020 | Bertsch | B65D 83/0094 |

FOREIGN PATENT DOCUMENTS

| | | | | |
|---|---|---|---|---|
| GB | 2581997 | A | | 9/2020 |
| JP | S55119040 | U | | 8/1980 |
| JP | H046618 | Y2 | | 2/1992 |
| JP | 3116673 | U | | 12/2005 |
| KR | 20160002199 | U | * | 6/2016 |

OTHER PUBLICATIONS

International Search Report and Written Opinion issued for PCT/US2022/019380, mailed Jun. 22, 2022, 13 pages.
European Patent Office, Extended European Search Report issued for EP22767822.4, mailed Feb. 6, 2025, 6 pages.

* cited by examiner

BLEND THROUGH CUP LID

CROSS REFERENCE TO RELATED APPLICATIONS

This application claims benefit of U.S. Provisional Patent Application No. 63/158,168 filed Mar. 8, 2021, the entire disclosure of which is herein incorporated by reference.

BACKGROUND OF THE INVENTION

1. Field of the Invention

There is described herein, among other things, a lid for a cup or other vessel, a cup with such a lid, and systems and methods for using such a lid which are designed for use with an automated blending machine where the blades of the blending machine access the contents of the cup through the lid.

2. Description of the Related Art

Blended drinks are extremely popular, and while structurally simple, are often relatively difficult to make. Products such as milkshakes, frozen blended drinks, frappes, and fruit smoothies are all forms of blended drinks. While they are quite different from each other, the process of making them is fairly similar. The drinks typically use some form of blending machine (commonly called a "blender") to grind solid or near solid materials into small particles which are then mixed into a liquid or emulsion in a generally suspended state. Some also provide for thickening agents or additives such as vitamins, often in the form of pre-powdered solids. The resultant drink is typically quite thick and viscous having a substantial amount of particulate matter suspended in a comparatively small amount of liquid. Blended drinks come in a plethora of different varieties utilizing all manner of solid and liquid combinations to create interesting tastes.

One of the best ways to make fresh fruits and vegetables available to consumers in an easy to consume form is via juicing or blending them into a beverage. Commonly called a "fruit smoothie" a blended drink of ground fruits and vegetables typically suspended in milk products, water, or other liquids can provide large amounts of plant nutrition in a convenient and highly portable form. Further, blending of fruit preserves much of the fiber present in them which is often considered healthier than juicing where the fiber is removed.

To make such blended drinks commercially, the blender is often more specialized than may be expected. Blenders, as opposed to other forms of food chopping apparatus, will often utilize the rotation of cutting blades to form a vortex within the blended material which vortex serves to continuously feed and refeed the material to the blades. This serves to create a uniform suspension with particles of controlled small size without the need for complicated blade arrangements. Other blenders utilize continuous augers and related structures to provide the system of refeeding material to the blades repeatedly.

As anyone who has ever used a blender to make a blended drink is aware, however, there is a relatively narrow band of liquid to solid ratios that work to get the blender to correctly form the vortex and feed the material. If there is too much liquid, the resultant drink will be runny and lack the desired thick and viscous consistency the drinks are known for. Alternatively, if there is not enough liquid, the cutting blades will tend to simply throw the solids around the blending chamber or loosely chop them instead of blending them into small particles in fairly uniform suspension in the liquid as the vortex does not form and the large chunks are not effectively refed to the blades.

Because of the difficulty in getting ratios right, professional establishments typically utilize specific high power and consistent machines to prepare such drinks. Further, many forms of blended beverages also require a wide range of ingredients. Fruit smoothies, for example, typically require multiple forms of frozen fruit which may have different water content. Professional establishments typically utilize such specific blending machines and specifically designed and ratioed recipes to produce high quality drinks. Further, items such as water content may be controlled by utilizing frozen materials instead of fresh. However, one thing most establishments have in common is that the blending is performed in a specialized vessel designed for the blender (and often including the blade). The drink is then poured from the blender vessel into the end cup which is given to the customer. This arrangement can create a large number of dishes as the blending vessel, blades, and other associated items need to be cleaned between each customer, and can create waste as the amount of the recipe often does not perfectly match the size of the resultant cup to deal with possible variations and human error in getting the ingredients into the blender, and the drink out of it.

In other commercial situations, to avoid the constant stream of blending containers needing to be cleaned, products may be made using immersion blenders. In these machines, product is usually initially placed in the cup which is to be provided to the customer, and then the cup is taken to a blending machine which has a blade assembly mounted to the bottom of a vertical shaft. This is a common arrangement for blending ice cream and other frozen desserts, for example. The cup is threaded over the end of the blender so the blades are placed in the cup. The blades are actuated in this arrangement by spinning the shaft and once blending is complete, the cup is taken by an employee to have a lid attached (if one is provided) and given to the customer.

While immersion blenders can be very effective, they have traditionally been completely unsuitable for a self-service or vending type of environment. Blending using such a device commonly requires the employee to move the cup around on the blade assembly and to visually inspect the product for proper blending. Further, once blending is complete, a lid may be placed on the cup if one is to be provided. The lid traditionally cannot be provided pre-blending as it would get in the way of positioning the open end of the cup onto the immersion blade assembly and maneuvering the cup to get proper blending. This means that an employee, who is obeying all proper sanitation protocols, is generally necessary to make sure that the drink is prepared in a sanitary fashion. Further, the immersion blending machine presents a necessary hazard as the spinning blade can be activated with no cup in place.

U.S. patent application Ser. No. 17/195,080, the entire disclosure of which is herein incorporated by reference, provides for various embodiments of machines which are designed to produce fruit smoothies in a self-service environment. These machines can produce fresh, on-demand smoothies that users can customize; they automatically self-clean, and they have a reduced footprint compared to other smoothie machines. These types of machines are designed to blend in the end consumer cup and, thus, have to deal with a situation where the blade assembly needs to be removably positioned within the volume of the cup during blending, but separable and removable from the volume of the cup when a customer wants to take their cup with them and consume the drink. Further, drink ingredients, in order to prevent tampering, are commonly provided sealed within the cup initially and it is desirable to not have an end user need to take off or add a lid at any time in the preparation process.

In certain self serve systems which utilize a lid for a cup or similar vessel, the user will get the cup with the lid attached and remove the lid prior to interaction with the machine. For example, this is often the case when refilling a disposable soda cup. While the machine is working, the user is forced to hold the lid in their hand or sit it down on a surface whose cleanliness they may not trust. Sometimes a consumer will dispose of the lid either not anticipating that they might need it afterwards, or simply because they didn't want to have to keep the lid in their hands. This type of action requires there to be additional lids provided to meet needs of customers who want lids, but inadvertently dispose of them. This is not desirable in most self-service arrangements.

SUMMARY OF THE INVENTION

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

There is described herein, among other things, a lid for a drink cup, the lid comprising: a main body including an outer ring configured to connect to a drink cup; a central disk including a central orifice through the main body, the central orifice including a plurality of bendable petals which extend to the edge of a hole which is generally in the center of the central orifice; and a generally circular groove between the central disk and the outer ring; wherein the groove is configured to mate with a peak mounted on a base of a blender bell; and wherein when the blender bell is mated with the lid, a blade assembly of a blender may pass through the orifice bending the petals.

In an embodiment of the lid, when the blade assembly is within a volume of the drink cup, a shaft supporting the blade assembly extends through the hole and the petals are generally unbent.

In an embodiment of the lid, the blades on the blade assembly contact the petals to cause them to bend when the blade assembly is entering the cup.

In an embodiment of the lid, the blades on the blade assembly contact the petals to cause them to bend when the blade assembly is exiting the cup.

In an embodiment of the lid, the contact between the blades and the petals causes the petals to push material on the blades off the blades.

In an embodiment of the lid, the groove includes an undulating base.

In an embodiment of the lid, the base of the blender bell includes an undulating ridge.

In an embodiment of the lid, the cup is generally in the form of a spherical segment of two bases.

In an embodiment of the lid, the hole is configured to hold a straw and create a seal between said straw and said petals without the straw bending the petals.

There is also described herein, in an embodiment, a sealed drink cup comprising: a cup; a lid including an outer ring connected to a rim of the cup, the lid including: a central disk including a central orifice through the main body, the central orifice including a plurality of bendable petals which extend to the edge of a hole which is generally in the center of the central orifice; and a generally circular groove between the central disk and the outer ring; and a seal attached to the central disk and covering the central orifice, the petals, and the hole.

In an embodiment, the cup further comprises: a band covering the connection between the cup and the lid.

There is also described herein, in an embodiment, a blender and cup combination for blending within the cup, the combination comprising: a cup; a lid including an outer ring connected to a rim of the cup, the lid including: a central disk including a central orifice through the main body, the central orifice including a plurality of bendable petals which extend to the edge of a hole which is generally in the center of the central orifice; and a generally circular groove between the central disk and the outer ring; a blender bell including a base having a peak configured to mate with the groove; and a blade assembly mounted on a shaft which may move the blade assembly from a first position within the blender bell to a second position within the cup; wherein when the blender bell is mated with the lid, movement of the blade assembly between the first position and the second position results in the blade assembly passing through the orifice bending the petals.

In an embodiment of the combination, when the blade assembly is within the cup, a shaft supporting the blade assembly extends through the hole and the petals are generally unbent.

In an embodiment of the combination, the blades on the blade assembly contact the petals to cause them to bend when the blade assembly is entering the cup.

In an embodiment of the combination, the blades on the blade assembly contact the petals to cause them to bend when the blade assembly is exiting the cup.

In an embodiment of the combination, the contact between the blades and the petals causes the petals to push material on the blades off the blades.

In an embodiment of the combination, the groove includes an undulating base.

In an embodiment of the combination, the base of the blender bell includes an undulating ridge.

In an embodiment of the combination, the cup is generally in the form of a spherical segment of two bases.

In an embodiment of the combination, the hole is configured to hold a straw and create a seal between said straw and said petals without the straw bending the petals.

DETAILED DESCRIPTION OF THE PREFERRED EMBODIMENT(S)

Figure 1:
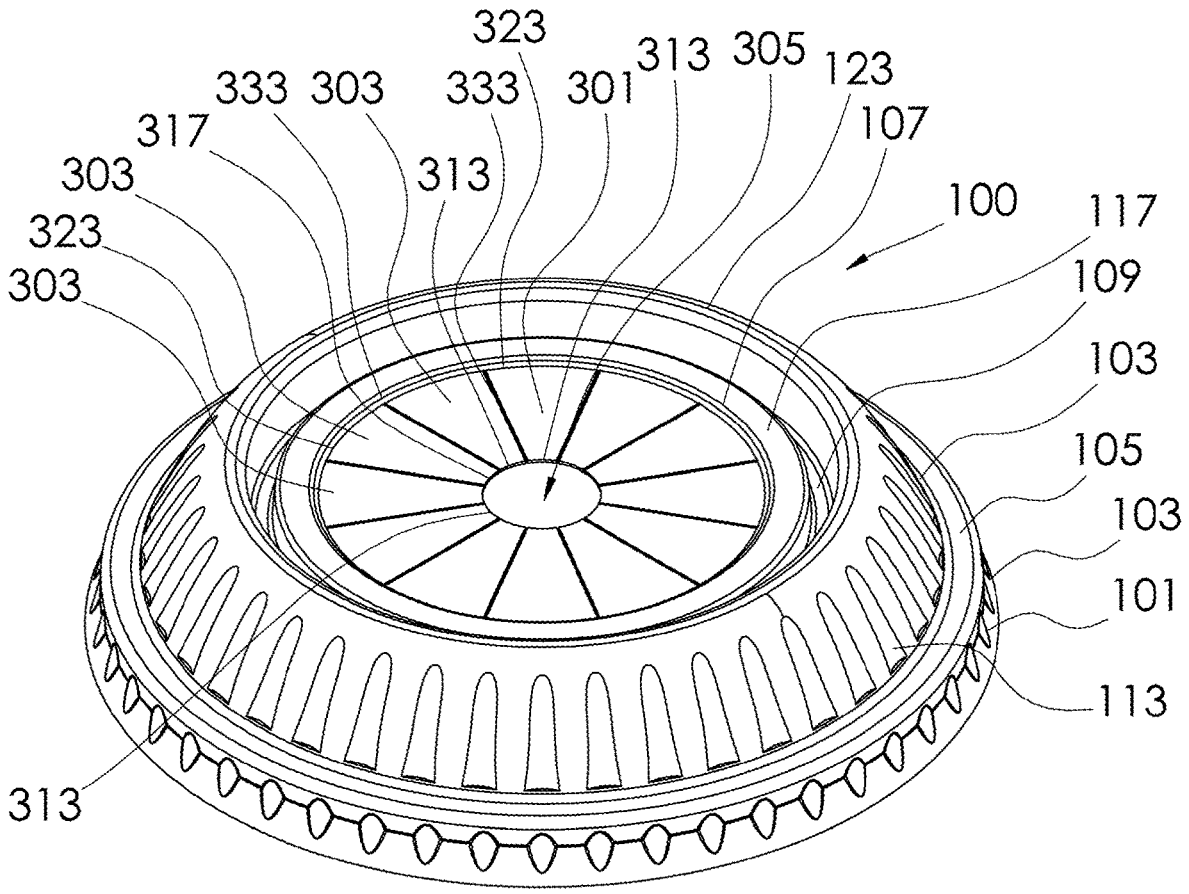
FIG. 1 depicts a perspective view of an embodiment of a lid which allows access of a blade assembly through the lid.
Figure 2:
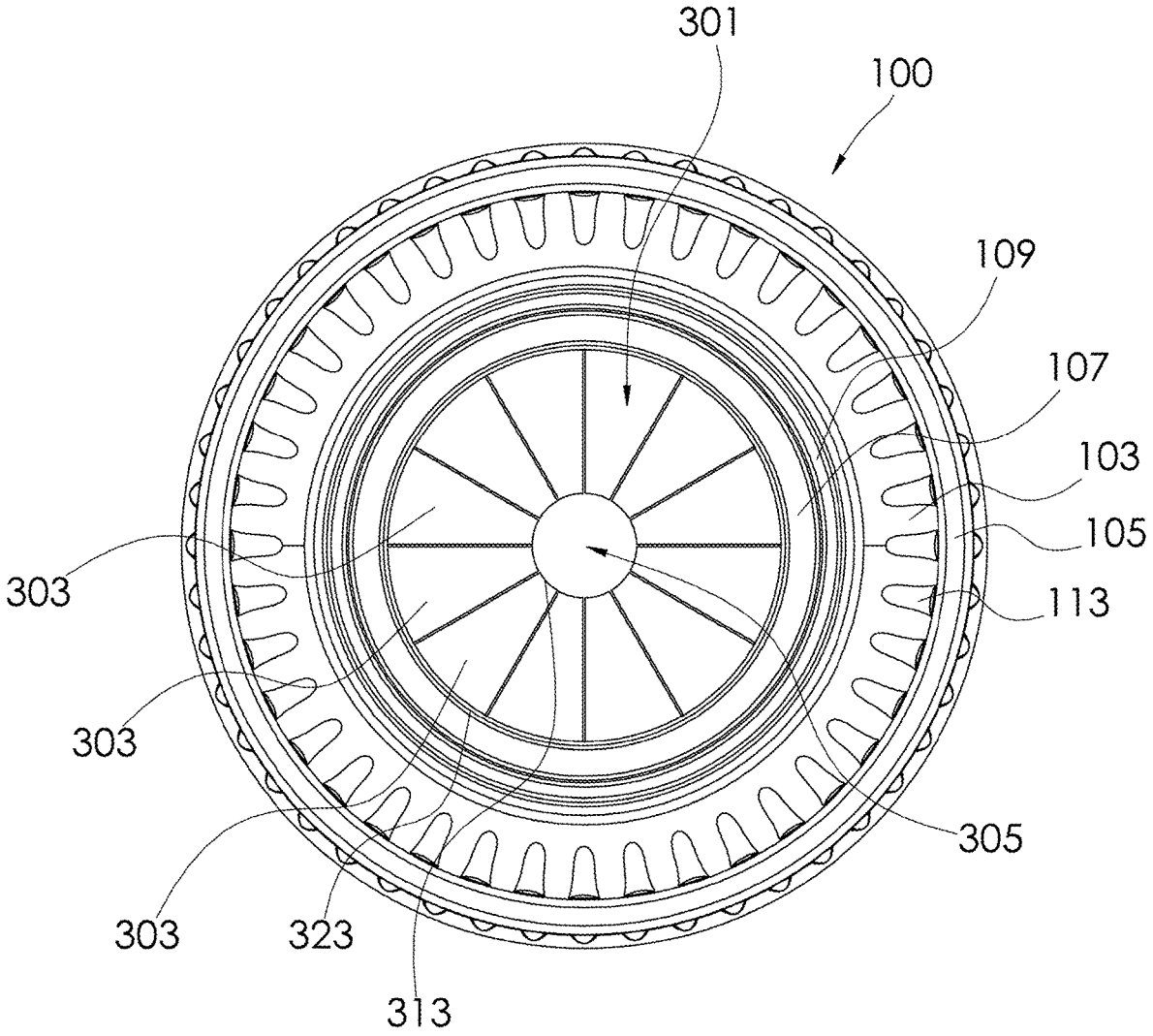
FIG. 2 is a top view of the embodiment of FIG. 1.

The following detailed description and disclosure illustrates by way of example and not by way of limitation. This description will clearly enable one skilled in the art to make and use the disclosed systems and methods, and describes several embodiments, adaptations, variations, alternatives and uses of the disclosed systems and methods. As various changes could be made in the above constructions without departing from the scope of the disclosures, it is intended that all matter contained in the description or shown in the accompanying drawings shall be interpreted as illustrative and not in a limiting sense.

This disclosure is provided in the context of a fully automated, self-serve blender such as those described in U.S. patent application Ser. No. 17/195,080 and U.S. Pat. No. 10,245,571 and Ser. No. 11,207,646. The entire disclosure of all the above documents is herein incorporated by reference. This disclosure will, therefore, make reference to machine elements of a machine such as those contemplated in the above referenced documents. However, it would be recognized by one of ordinary skill in the art that the cup lid and cup contemplated herein may be used in any context where a lid which can be penetrated by a larger object than would fit through a traditional straw hole without damage is desired.

Self-service machines that utilize a blend-in-cup process so the drink is made within a (generally disposable) cup that is taken by the consumer after the blending process is complete eliminates the need to transfer the beverage to a cup after blending. Further, this type of arrangement also allows the raw material to be blended (for example frozen fruit) to be provided in an unblended but prepackaged and pre-partitioned state. With regards to the use of fruit in smoothies, this can result in a higher quality smoothie without causing a break-down of nutrients due to oxidation which typically happens in a standard blender.

Specifically, keeping the fruit in a sealed container until immediately prior to blending allows environmental control. Not mixing air in smoothies during the blend sequence and through oscillating blender blades at a low RPM also allows for improved quality to be maintained. Furthermore, by using an individual serving cup where the contents, once filled, are handled only by the end user, and with minimal food contact from the machine, the machine is able to minimize the amount of material wasted in each blending cycle, reduce cleaning requirements, and provide a safer food handling experience.

While this disclosure will utilize terms such as "above", "below", "forward", "back", "left" or "right" these terms are used as a matter of convenience to describe the typical arrangement of a device when interacted with by a human user and are not intended to imply an absolute direction relative to the Earth or other body. For example, while a first object which is "below" a second object will typically be closer to the earth than the second object in routine operation, this is not intended to be required as the devices herein could be oriented in any direction relative to the Earth or relative to any gravitational field (or without one, such as in deep space). Instead, these terms are used to show relative positioning of objects to each other. Thus if a third object was "above" the second object in the prior example, the three objects would typically be arranged generally linearly from the first object, to the second object, to the third object regardless of the various objects' positions in space. Similarly, an object on the right would be on a generally opposing side to an object on the left and movement forward would be in the generally opposing direction to movement backward.

FIGS. 1-4 provide various illustrations of a lid (100) and a disposable cup (200) for use therewith which is particularly well-suited for use in a self-service blending environment where material (551) is initially provided in unblended form in the disposable cup (200), is blended in the disposable cup (200), and the disposable cup (200) is used by the end user during consumption of the material (551) in its blended form. The cup (200) may be of any type and made of any material but will typically be plastic (often clear plastic to allow visual inspection of its contents) or similar materials. It will typically be intended for single use, but may be reusable in certain embodiments or under certain conditions. The cup (200) usually has a typical inverted conical frustum shape, although this is by no means required, and includes a hollow interior and a single large opening taking up all or nearly all of its uppermost surface.

In the depicted embodiment, the lid (100) is in the form of a typical disposable cup lid having a generally circular cross section (corresponding to the top of the cup (200)) whose outer ring is designed to "snap" onto the upper rim of the cup (200). This is by the cup (200) including a raised lip extending outward from the rim to interact with the lid (100). The lid (100) typically attached by having an outer circumferential ring (101) including a detent (102) which extends inward toward the center of the lid (100) generally all the way around the circumference.

The detent (102) is displaced by the lip at the upper rim of the cup (200), typically by the detent (102) simply having a slightly deformable structure, and the detent (102) will return to position after it has cleared the lip. The lid (100) will, thus, be attached to the cup (200) by the resistance between the detent (102) and the lower portion of the lip. This is typically not a sufficient force to keep the two from separating at all, but will typically keep the lid (100) in place unless force is applied to deform the lip and/or detent (102).

In the depicted embodiment of FIGS. 1-4, the lid (100) is generally in the shape of a spherical segment of two bases. That, is the lid (100) is generally a hemisphere or dome which has had the top cut off along a plane generally parallel to the plane forming the bottom. In the depicted embodiment, the outer curved wall (103), which defines the altitude of the spherical segment, includes a plurality of stiffening elements (113) and is inset by a spacer (105) from the circumferential ring (101) used for attachment to the cup (200). This spaced arrangement will typically make it easier to connect the lid (100) with the cup (200), but it is by no means required.

Figure 3:
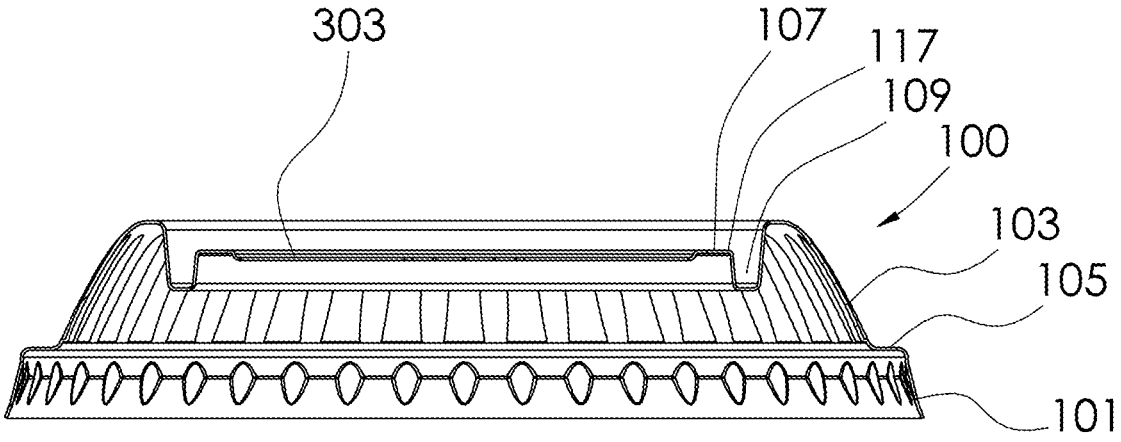
FIG. 3 provides a cut-through of the embodiment of FIG. 1 along a diameter line.

In the depicted embodiment, the upper base is in the form of a thin ring (123) as opposed to a flat solid surface, and includes within it a recessed central disk (107). The disk (107), as can be best seen in FIG. 3, is spaced from the outer curved wall (103) by a circular trough or groove (109). This groove (109) effectively forms a channel around the central disk (107) between the central disk (107) and the outer wall (103).

Figure 4:
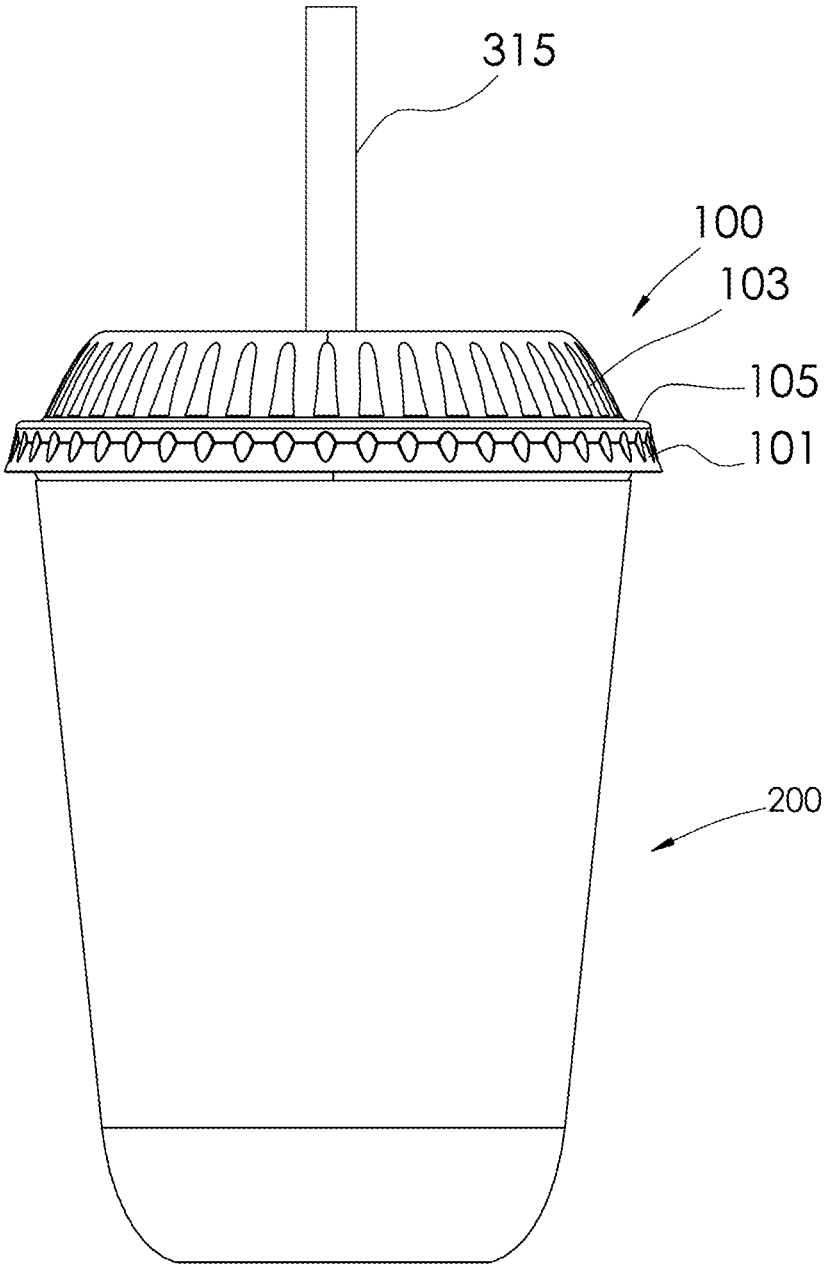
FIG. 4 shows the embodiment of FIG. 1 in place on a disposable drink cup with a straw inserted.

The central disk (107) also is typically not a flat solid surface, but includes a slightly raised rim (117) surrounding an orifice (301). The orifice (301) is partially closed by a plurality of flexible petals (303) which extend from the rim (117) toward the center of the disk (107) but leave open a central, generally circular, hole (305). The hole (305) is typically sized and shaped to have a suitable straw (315) placed therein as illustrated in FIG. 4. Typically, the straw (315), which may have a greater diameter to a typical drinking straw due to the viscosity of smoothie drinks, will contact the inner surfaces (313) of the petals (303) which may assist in holding the straw (315) upright.

One of the purposes of the embodiment of lid (100) is that the structure of the lid (100) allows for keeping the lid (100) in place on the cup (200) during blending. Specifically, the petals (303) are designed to allow processing equipment, and particularly the blade assembly (501) to penetrate it and travel through as it slowly opens. This also allows the blade assembly (501) to retract smoothly after the processing. Blending in a cup (200) with a lid (100) in place where both are intended to be taken by the user as part of intended consumption, can significantly reduce the amount of service area of the machine in food contact. This can reduce the amount of the machine to be cleaned between blending operations, can minimize food waste, and can improve general user experience. The lid (100) also is sized and shaped and includes a variety of specific hills and valleys which interact with a counterpart component on the blending equipment. This allows for moving components on the blending equipment to be automatically centered on the cup (200), the cup (200) to be held in place and avoiding any spillage, and inhibit cup (200) movement during blending of material within the cup (200).

Figure 5A:
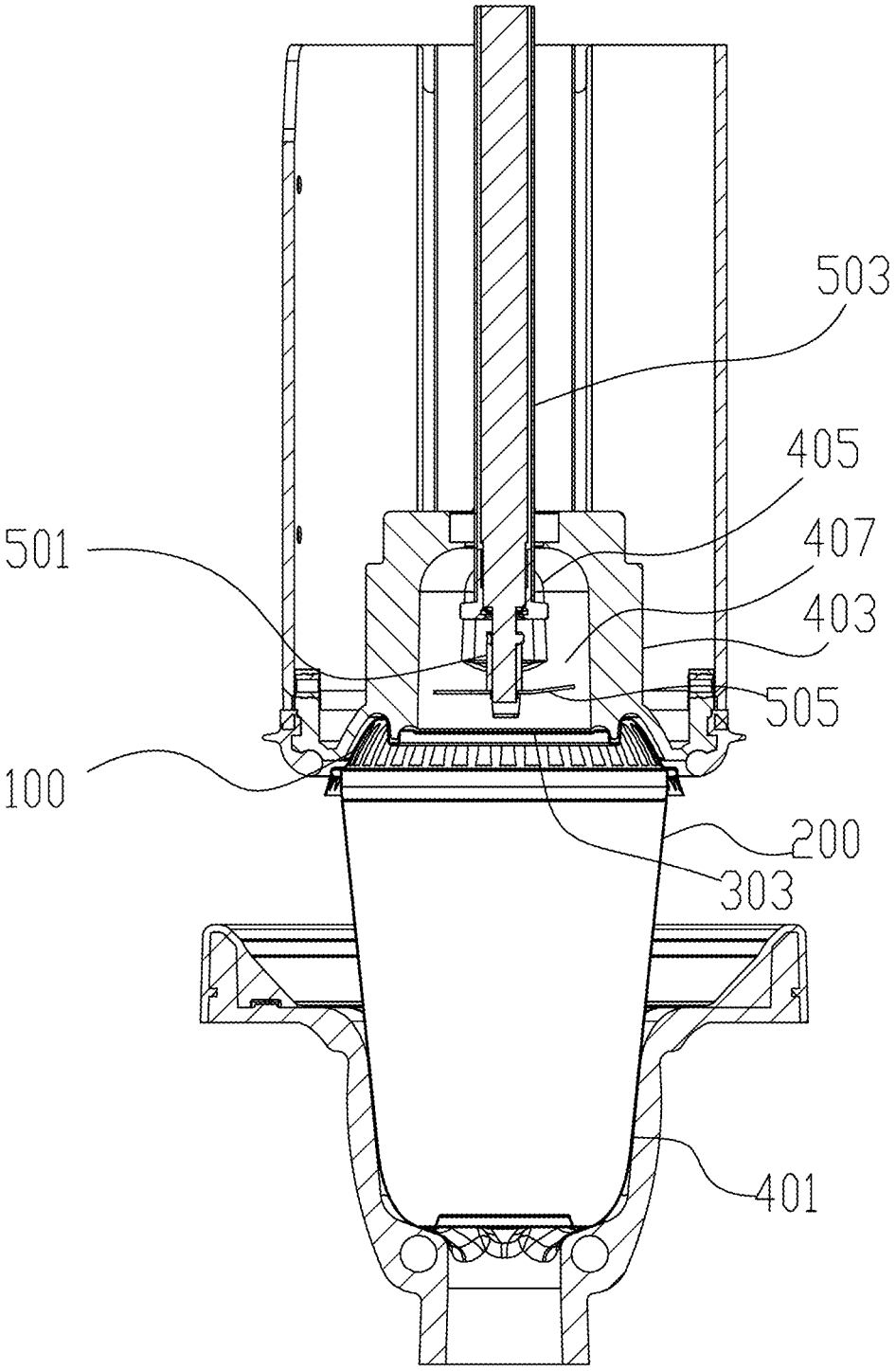
FIGS. 5A, 5B, 5C, 5D, 5E, and 5F show the movement of the blade assembly into and out of the cup showing bending of the petals during such movements.

FIGS. 5A-5F provide for a general walkthrough of how the lid (100) is designed to interact with a blending machine. In the first instance, the cup (200) and lid (100) combination is obtained and readied for use. This can include removing seal (901) as contemplated in FIGS. 10 and 11 and discussed later. The cup (200) will generally be placed in a basin (401) and may be secured or simply held in place by friction as contemplated later. The blending bell (403), which includes the blade assembly (405) therein, will descend and contact the lid (100). As can be seen in FIG. 5A, this is the starting position of the interaction. The underside of the blending bell (403) will typically be sized and shaped to interact with the lid (100) as is discussed in more detail in conjunction with FIG. 6.

During or after the descent of the blending bell (403), safety shields and other related systems (not shown) may be actuated to inhibit access to the cup (200) or lid (100) during blending. Once the blending bell (403) has descended and contacted the lid (100) the lid (100) and cup (200) combination is effectively pinched between the inner walls of the basin (401) from below and the blending bell (403) from above and the system is as shown in FIG. 5A. The interaction of the blending bell (403) and lid (100) is discussed in increased detail in conjunction with FIG. 6.

In the position of FIG. 5A, water may be added to the cup (200). In an embodiment, the blending bell (403) has a connection to a freshwater line that is routed through the blending bell (403) and opens up within the inside cavity (407). Once the blending bell (403) mates with the cup (100) as in FIG. 5A, a specific amount of freshwater or other liquid (e.g. based on a thickness intended for the resultant drink) is added through that water line and typically reaches the hole (305) in the middle of the lid (100). The hole (305) can be widened by pushing down the petals (303) via the blades (505) or other parts of the blade assembly (501) such as is shown, for instance in FIGS. 5B and/or 5C should faster water flow into the cup (100) be desired. There will typically be a pressure release hole in the top of the blender bell (403) which will allow for air to be released while water is added to the cup (200). This pressure release hole allows pressure within the cavity (407) to be released while restricting the outflow of any liquid.

In another variation, the system can use a combination of the self-centering of the lid (100) design to push the cup (200) and lid (100) assembly in place via the blender bell (403) to ensure it is in the correct position and accommodate for any user error. A nozzle (not shown) in the blender bell (403) can be positioned precisely via a computer/sensor system to inject water through the lid while allowing air to escape to ensure no spilling and a precise of liquid is added to the cup (200) to ensure the correct quantity of water/liquid ratio.

Figure 5B:
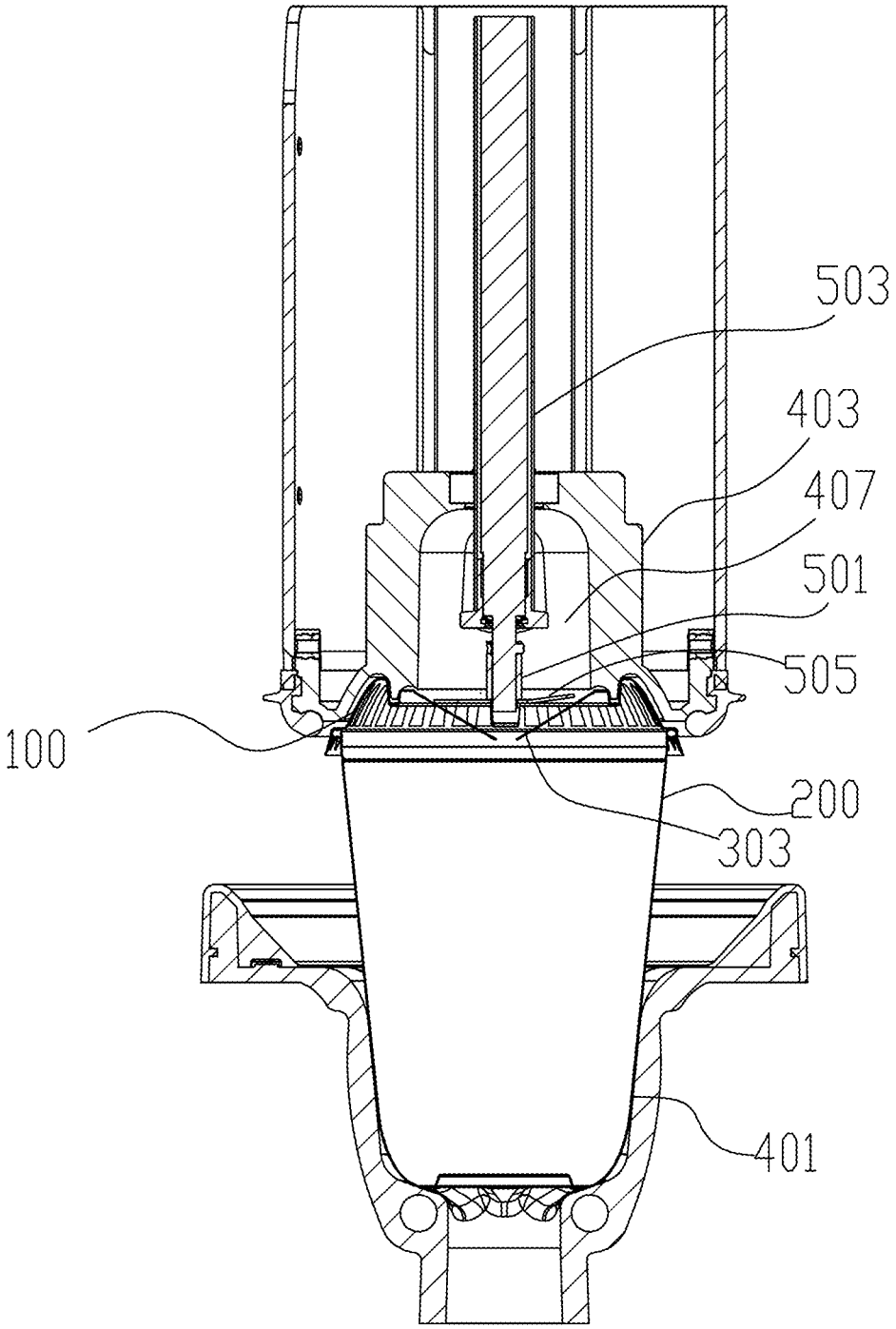

Once the water is added to the material (551) in the cup (200), the blade assembly (501) will travel further down into the cup (200). Specifically, the blade assembly (501) will descend into and through the orifice (301). As shown in FIG. 5B, as this happens the end of the blade assembly (501) (which may be a portion of the shaft (503)) will typically extend into the hole (305). The blades (505) will then typically contact the petals (303) which will cause them to displace downward by them bending at their bases (323) typically simply using the flexibility of the material of which the lid (100) is made to form a natural hinge.

In FIG. 5B, the initial contact and displacement of the petals (303) is just beginning to occur. The number of petals (303) contacted and bent by the blades (505) and/or other parts of assembly (501) will depend on the specific size and shape of the blades (503) and assembly (501). In some cases, all the petals (303) may be bent while in other cases, only one or two may be.

Figure 5C:
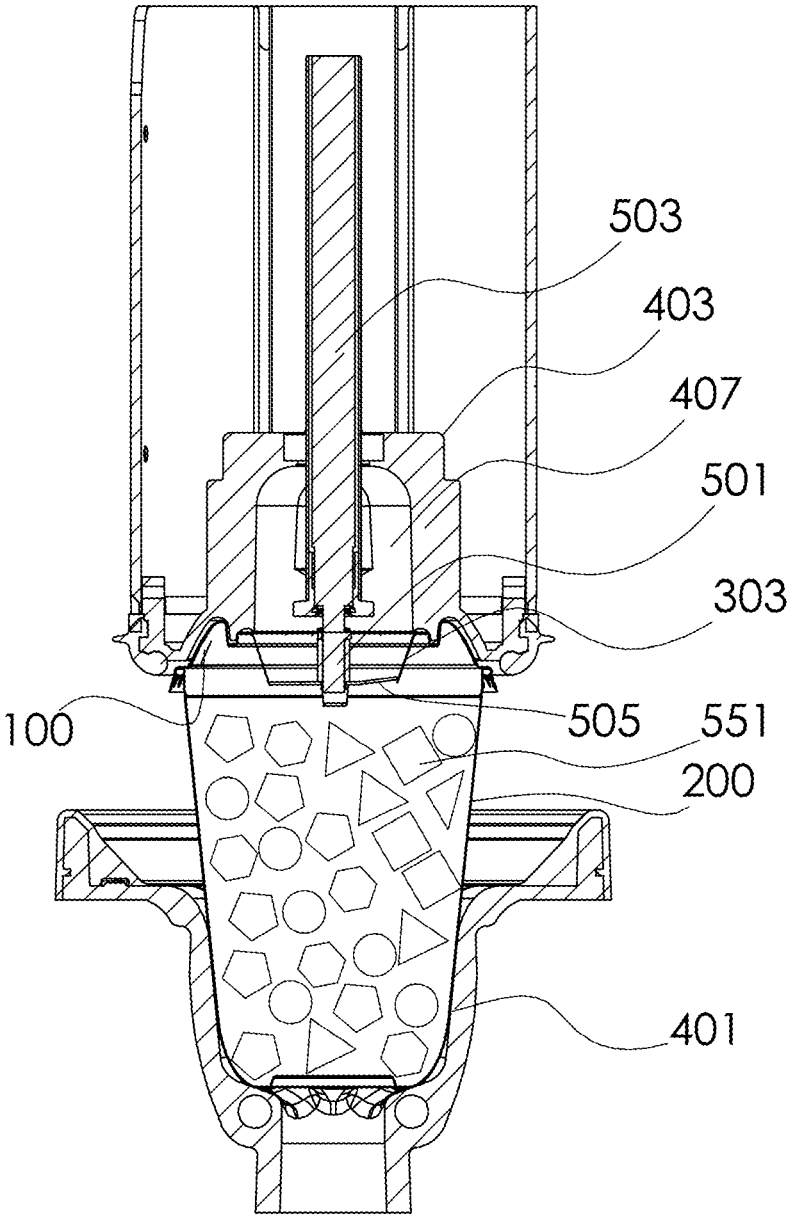

Regardless of the number of petals (303) contacted, the petals (303) contacted by the blades (505) and/or assembly (501) will bend downward. They will also typically separate from each other increasing the gaps (333) between them. The blades (503) will typically slide along the petals' (303) upper surface as the assembly (501) descends. In FIG. 5C, the assembly (501) is shown at a position where the blades (503) are just contacting the inner edges (313) of the petals (303). The petals (303) are also shown bent downward to essentially their maximum position as the head (501) continues to push through the orifice (301). As shown in FIG. 5C, material (551) in the cup (200) will often be at a level below the distance that the petals (303) can bend but this is by no means required. This keeps the material (551) from inhibiting the movement of the petals (303) into the cup (200) as the blade assembly (501) descends. In an embodiment, computer sensing may be used to prevent strain or damage of the lid (100) in case of defects in the production process. For example, resistance indicative of the petals (303) not being cut apart could result in retracting the blade assembly (501) and an error indication to the user to prevent damage.

Figure 5D:
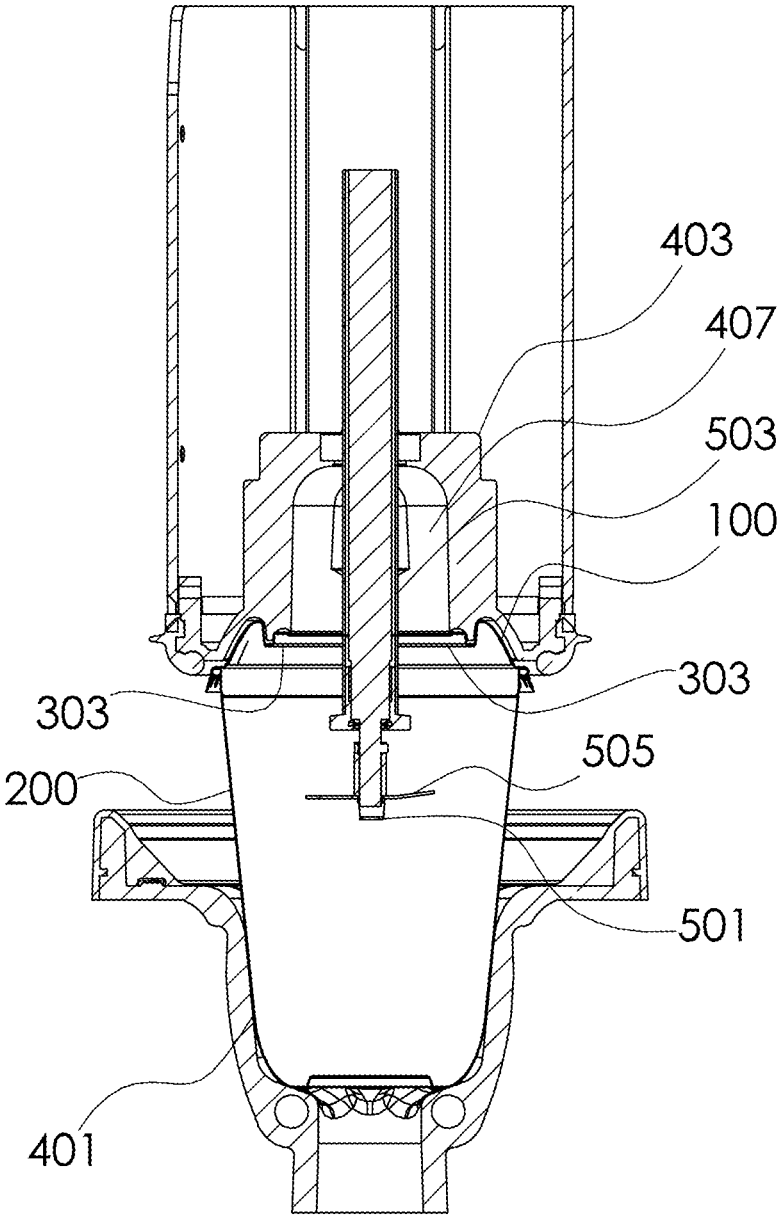

Once the blades (505) pass over the ends (313) of the petals (303) the petals (303) will return to their original unbent position. This is shown in FIG. 5D. Typically, the shaft (503) will extend through the hole (305) in the center of the orifice (301) at this time. While in FIG. 5D, the shaft (503) has a generally similar diameter to the hole (305) so that the shaft (503) generally fills the hole (305), this is by no means required and in alternative embodiments, the shaft (503) may be slightly smaller or larger than the hole (305). In the former situation, there will be a gap between the inner edges (313) while in the latter, the petals (303) will still be bent slightly downward in the position of FIG. 5D.

Regardless of the specifics of the size of the hole (305), it is generally preferred that the shaft (503) and hole (305) have similar diameter so as to produce a fairly close connection between the two. By having the inner edges (313) close to or in contact with the shaft (503), when the blades (505) are rotated, matter (551) inside the cup (200) which may be projected upward will typically hit the petals (303) or other part of the lid (100) and cannot easily escape the cup (200). This provides for less waste and also helps keep the cup (200), lid (100), and machine (and particularly the cavity (407) of the blending bell (403)) cleaner.

After the position of FIG. 5D, the blades (505) may be lowered further into the cup (200) to provide for the blending action. This will typically involve the shaft (503) simply passing through the hole (305). The final position for blending will typically depend on the specific cutting and rotational action of the blades (505) and how they are shaped as well as if vertical movement of the blades during blending is desired. Regardless, it is typically undesirable for the blades (505) to push down too far into the cup (200) as this may cause the blade assembly (501) to hit and damage the bottom of the cup (200) or the blades (505) may cut into the bottom of the cup (200). To achieve appropriate positioning, the blender bell (403) and/or other components of the blender mechanism may include a spring or other biasing member which provides for resistance for the blades (505) to go too far into the contents of the cup (200).

In an embodiment, sensors and associated software or other control may be used to recognize the lid (100) and avoid any stalling of the blades (505) or blade assembly (501) when it is lowered into the cup through the lid (100). This can help improve reliability and durability of the entire system, ensure a consistent, premium user experience, and avoid any health and safety concerns should the lid (100) be deformed or incorrectly positioned in such a way that the blade cuts the petals (303) during the various movements.

In an embodiment, as the blades (505) present a large generally flat surface when descending, they may be expected to compress some material (551) under them as the blade assembly (501) descends. This will often increase as the blade assembly (501) gets lower in the cup as more material (551) is trapped and compressed. This increase in resistance can be used as a method to determine when the blade assembly (501) has descended the correct distance based on the composition of the material (551) in the cup (200).

Alternatively, the head (501) can descend essentially all the way into the cup (200) with the resistance of the cup (200) bottom being detected as different from the material (551) in the cup (200). The shaft may then be moved to position the blade assembly (501) at a specific distance from the bottom. This latter arrangement will typically be preferred as it allows the blades (505) to rotate at or near the bottom of the cup (200) which will typically produce a more uniform product as gravity and vortex action will help act to feed material into the blades (505). In yet another alternative embodiment, the distance of blade (505) descent may simply be controlled by an absolute or relative movement distance from the known starting position based on the type of cup (200) present or by any other means or method known to one of ordinary skill in the art.

With the blade assembly (501) properly positioned at the desired blending position, the blending takes place. In the blending position the petals (303) of the lid (100) are back in their generally horizontal position as contemplated above in FIG. 5D and, in conjunction with the shaft (503) being in the hole (305) generally serve to seal the orifice (301). If desired, in some embodiments the blade assembly may move up and down within the cup (200) during blending since the shaft (503) can typically pass through the hole (305) without disturbing the petals (303) further. Having the shaft (503) not bend the petals (303) inhibits any rotation of the shaft (503) (should it rotate and not utilize an internal rotation mechanism) from damaging or breaking the petals (303) during blending Once the blending operation is finished, the blade assembly (501) will retract vertically back to its original position with the blade assembly (501) in the cavity (407) of the blender bell (403). This requires the blade assembly (501) to again pass through the lid (100), but in the opposite direction. As the petals (303) have generally returned to their unbent position in FIG. 5D, the flexible petals (303) now allow the blades (505) to move out of the cup (200) into the cavity (407) inside the blade bell (403) while still holding back in the cup much of the smoothie residue which may be on the blades (505).

Figure 5E:
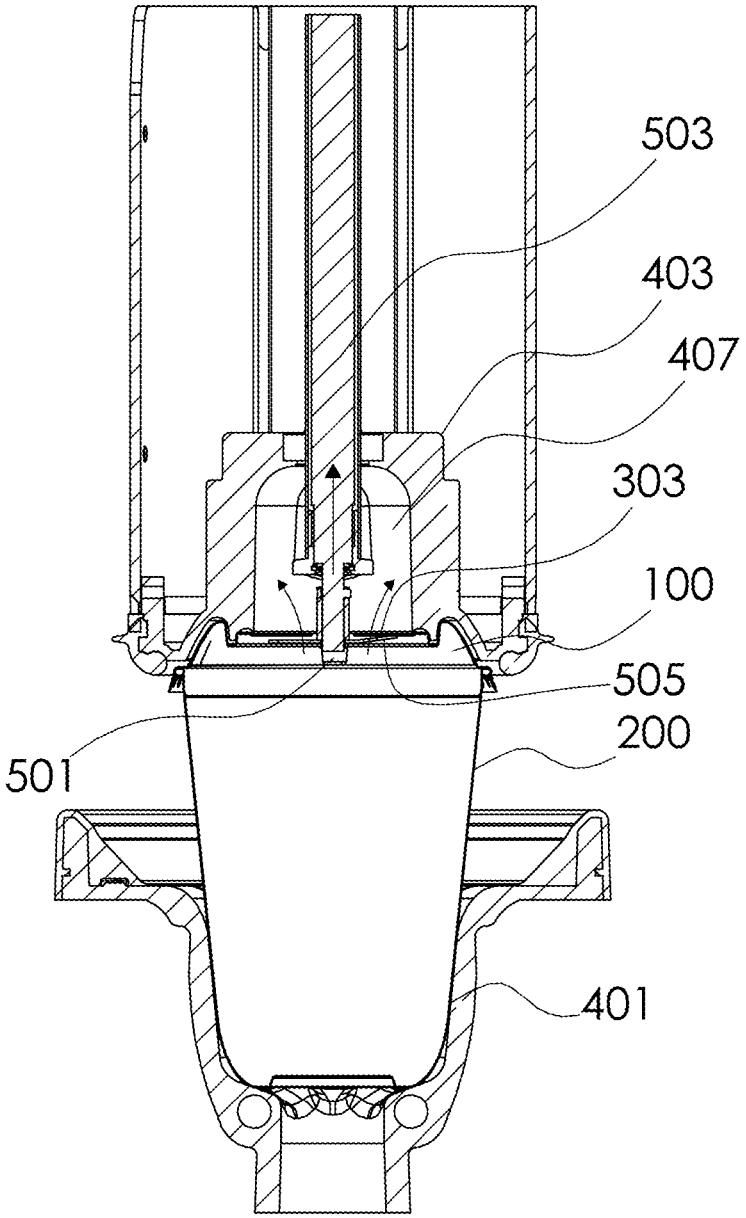

As can be seen in FIG. 5E, as the blade assembly (501) rises, the blades (505) will contact the underside of the petals (303) and begin to push them upward. Further, during the transition from FIGS. 5E to 5F, the motion of the petals in the retraction is essentially the same as in the initial penetration (FIGS. 5B and 5C) except with the petals bending in the opposing direction. This will serve, at least partially, to "wipe" the petals (303), as well as the shaft (503) above the petals (303), along at least portions of the blades (505) which will generally serve to push off material (551) that may be clinging to the blades (505). As the blades (505) are still below the petals (303) the material (551) will tend to fall back into the cup (200) from this wiping motion.

Figure 5F:
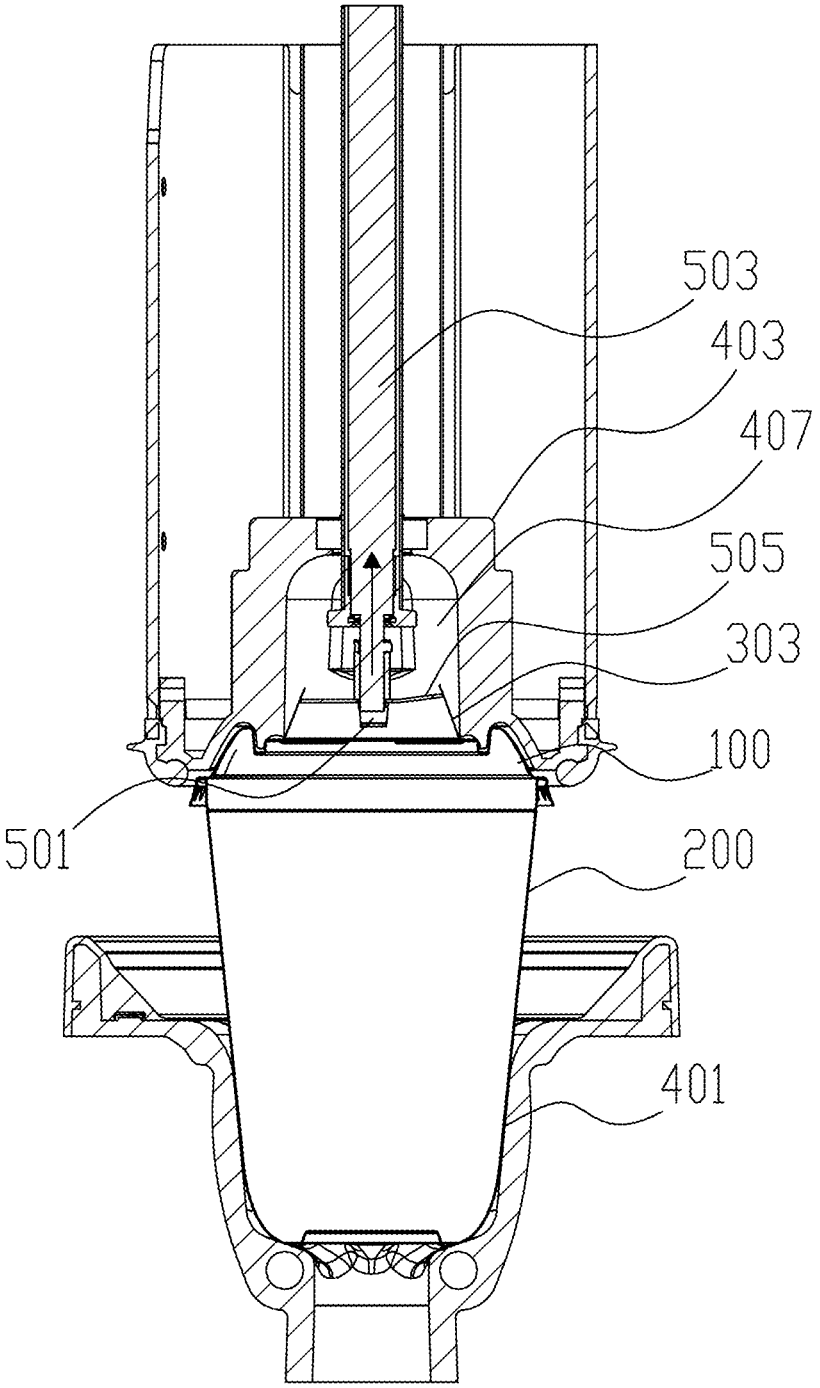

To avoid any spillage beyond the food contact zone inside the cavity (407) of the blender bell (403) the blender bell (403) is generally pushed down by a spring or similar item onto the lid (100) while the blades (505) pass through the petals (303) as in FIGS. 5E and 5F. This serves to inhibit the cup (200) and/or lid (100) from being lifted upwards out of the basin (401) and/or from the cup (200) and lid (100) separating due to the force of the blades (505) on the petals (303).

Once the blade assembly (501) has returned to the cavity (407) as in FIG. 5A, the user will typically remove the cup (200) and lid (100) combination and the process is complete. At this time, there may still be material (551) on the blades (505), other parts of the blade assembly (501), or the shaft (503). Typically, the shaft (503) will have retracted through a wiper (457) which will serve to remove most, if not all, material from the shaft (503) above the cavity (407). As the blades (505) are not rotating in the blender bell (403), this material, if sufficient, will typically simply drip into the basin (401). The shaft (503) and wiper (457) interface is designed to minimize friction so as not to strain the system or crush the lid (100) but at same time have sufficient seal so prevent any smoothie material from traveling above the blender bell (403)

In addition to providing for blender penetration through the orifice (305) as discussed above, the lid (100) can also serve to align the blade assembly (501) and shaft (503) in the center of the cup (200). This can be very helpful to inhibit the blades (505) from being able to potentially contact the side of the cup (200) as well as to best position the shaft (503) in the hole (305) to inhibit splashing of material from the cup (500) into the cavity (407) of the blending bell (403) during blending. As the cup (200) is also placed by a user and may include variations due to, for example, manufacturing tolerances, the cup (200) also may not be entirely straight in the basin (401) when the blending bell (403) descends.

Figure 6:
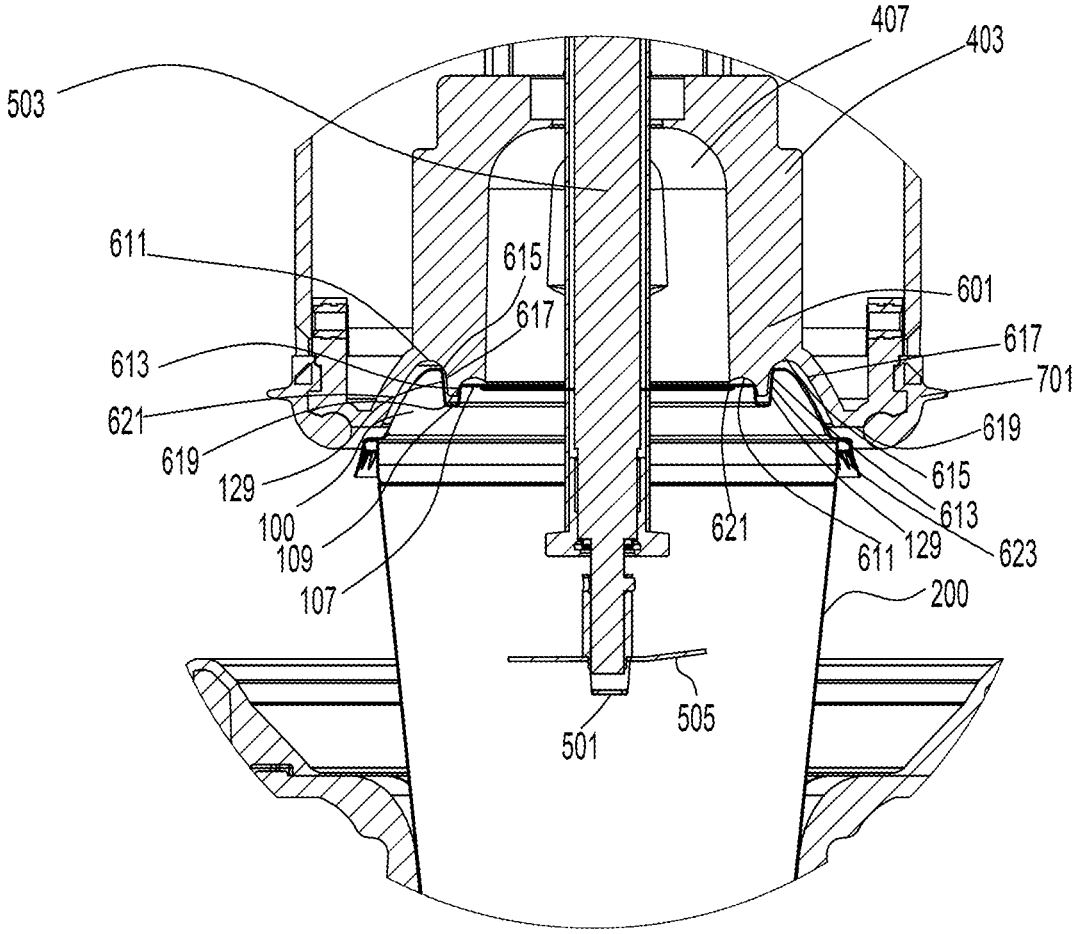
FIG. 6 shows a detail view of FIG. 5D. This better illustrates the details of the self-centering mechanisms and interaction of the blender bell with the lid.

FIG. 6 shows a detail view of the interconnection of the blender bell (403) and lid (100) in the position illustrated in FIG. 5D to illustrate self-centering of the bell (403) on the lid (100). As can be best seen in FIG. 6, the blending bell (403) includes a hollow interior cavity (407) which serves to house the blade assembly (501) when it is not in use as illustrated in FIG. 5A and discussed above. The generally ring-shaped base (601) of the blending bell (403) around the hollow interior cavity (407) will generally not be flat but will include a cross section, such as that illustrated in FIG. 6, which includes multiple peaks and valleys. This specific arrangement of FIG. 6 is not required, but provides an example of how to mate with the lid of FIGS. 1, 2, and 3.

In the embodiment of FIG. 6, there is a shallow valley (611) which is the innermost position and extends from the inside circumference (621) to the first peak (613). The first peak (613) typically extends below the inside circumference (621) and is typically sized and shaped to correspond to the groove (109) in the lid (100). This first peak (613) is bounded on its outer side by the deep valley (615) which will typically extend a greater distance into the structure of the blending bell (403) than the shallow valley (301). The outermost side of the deep valley (301) is then bounded by a curved ridge (617) which extends below the first peak (613). This curved ridge (617) extends to the terminating surface (619) which forms the typically lowermost portion of the main structure of the blending bell (403). The terminating surface (619) in the depicted embodiment is then surrounded by a gasket (701) or similar device which is designed to provide a close seal to a generally rigid flat surface as contemplated in conjunction with FIG. 9 but which is beyond the sides of the lid (100) as shown in FIG. 6.

As can be seen in FIG. 6, the various peaks (613) and valleys (611) (615) are designed to variably contact various corresponding structures in the lid (100). In the embodiment of FIG. 6, the first peak (613) for example, will extend into the groove (109) and part of the exterior wall (623) of the first peak (613) will typically frictionally engage the wall (129) of the groove (109). Similarly, all or portions of the shallow valley (611) may contact some or all of the disk (117) and the deep valley (301) and curved ridge (617) may contact the curved wall (103) and/or the interconnection between the groove (109) and the curved wall (103). Further, while specific points of contact are illustrated in FIG. 6, one of ordinary skill in the art would understand that these particular contact points are by no means required and are simply illustrative of the general operation and interrelationships that may be used.

Typically, the various engagements between the base (601) and the lid (100) shown in FIG. 6 will simply be frictional interactions between the various interacting surfaces. However, in alternative embodiments, the base (601) of the blending bell (403) may actually serve to distort, distend, or otherwise modify the shape of the lid (100) to provide for a strong connection. Regardless of the method of engagement, it will typically be the case that the lid (100) will be securely held by the contact with the blending bell (403). Further, this contact may be maintained through the use of a spring or other biasing mechanism which will serve to regulate the amount of pressure exerted by the blending bell (403) on the lid (100).

This force and resultant friction will typically be sufficient to inhibit the lid (100) from rotating or otherwise moving during blending. Further, the cup (200) will typically be pushed into the basin (401) (and also tilted to be upright and solidly against the base (601)) by the action of the blending bell (403) pushing downward on the lid (100). Engagement of the cup (200) with the basin (401) will also typically be a frictional engagement so as to not damage the cup (200) or impair its appearance when it is removed. The frictional engagement between cup (200) and basin (401), along with the frictional engagement of the lid (100) to the cup (200) and the lid (100) to the blending bell (403) will inhibit both the cup (200) and lid (100) from rotating during blending and from moving relative to each other. In an embodiment as depicted in FIG. 6, the shape of the base (601) may also be formed to accommodate interfacing with the rim of the cup (200) should the lid (100) have been removed.

Figure 7:
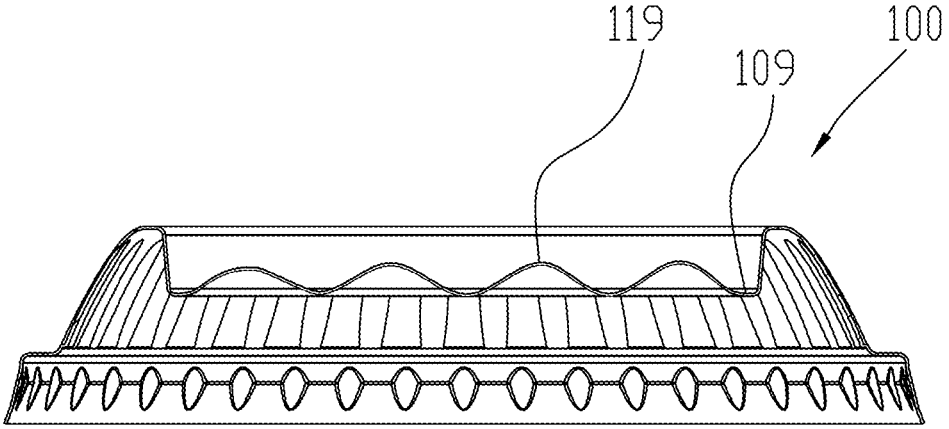
FIG. 7 shows a cut through of an alternative cup lid which includes a wave pattern within the circumferential groove for helping to avoid rotation of the cup and lid.

In the event that the drink is particularly viscus, or where the above frictional connections are otherwise insufficient to inhibit rotation, an alternative embodiment of the lid (100) as shown in FIG. 7 may be used. In this embodiment, the groove (109) includes an undulating lower surface (119). This surface (119) may utilize any waveform or otherwise repeating pattern of troughs and valleys. The first peak (613) of the blending bell (403) base (601) will typically include a mating pattern (which may be the same pattern as surface (119)) to surface (119). Typically, when the cup (200) is placed and the blender bell (403) descends, the lid (100) will be forced to rotate either relative to the cup (200) or with the cup (200) to align the surface (119) with the mating surface on the blending bell (403). Specifically, the interactions of the peaks and mating valleys of the surfaces (119) and base (601) will push the lid (100) into a mating position. Once aligned, it is very difficult to rotate the lid (100) as the downward force of the first peak (613) on the trough (109) must be completely overcome for the lid (100) to rotate to a different position. To put this another way, once the waves connect, there is generally little to no radial movement between cup (200) and lid (100) even if the blade assembly (501) rotates violently. There is also generally no radial movement between the cup (200) and lid (100) combination and rest of the entire blender assembly.

Figure 8:
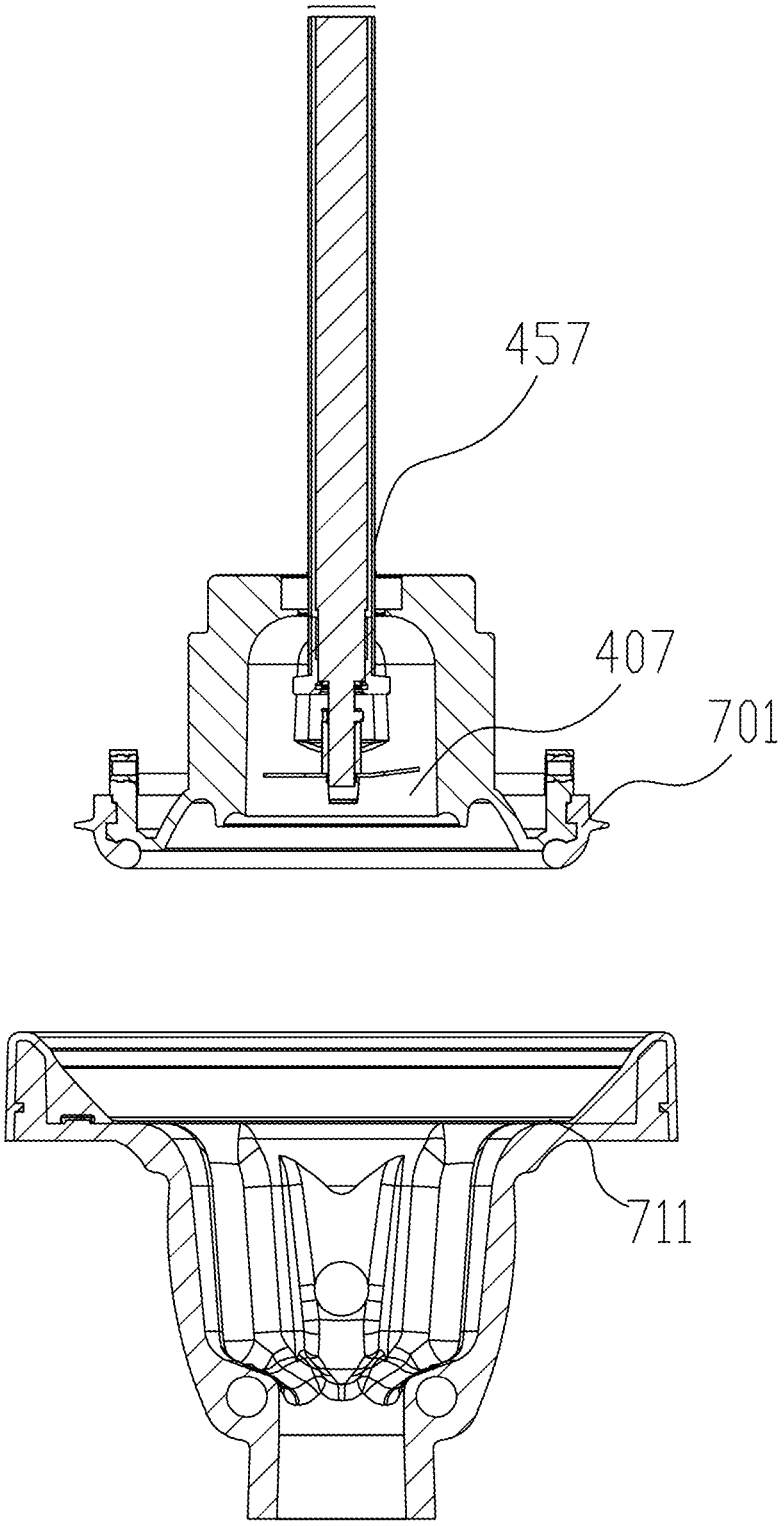
FIG. 8 provides a cut through which illustrates the blending head in a raised position after the cup has been removed. This is effectively a "ready" position of the machine.
Figure 9:
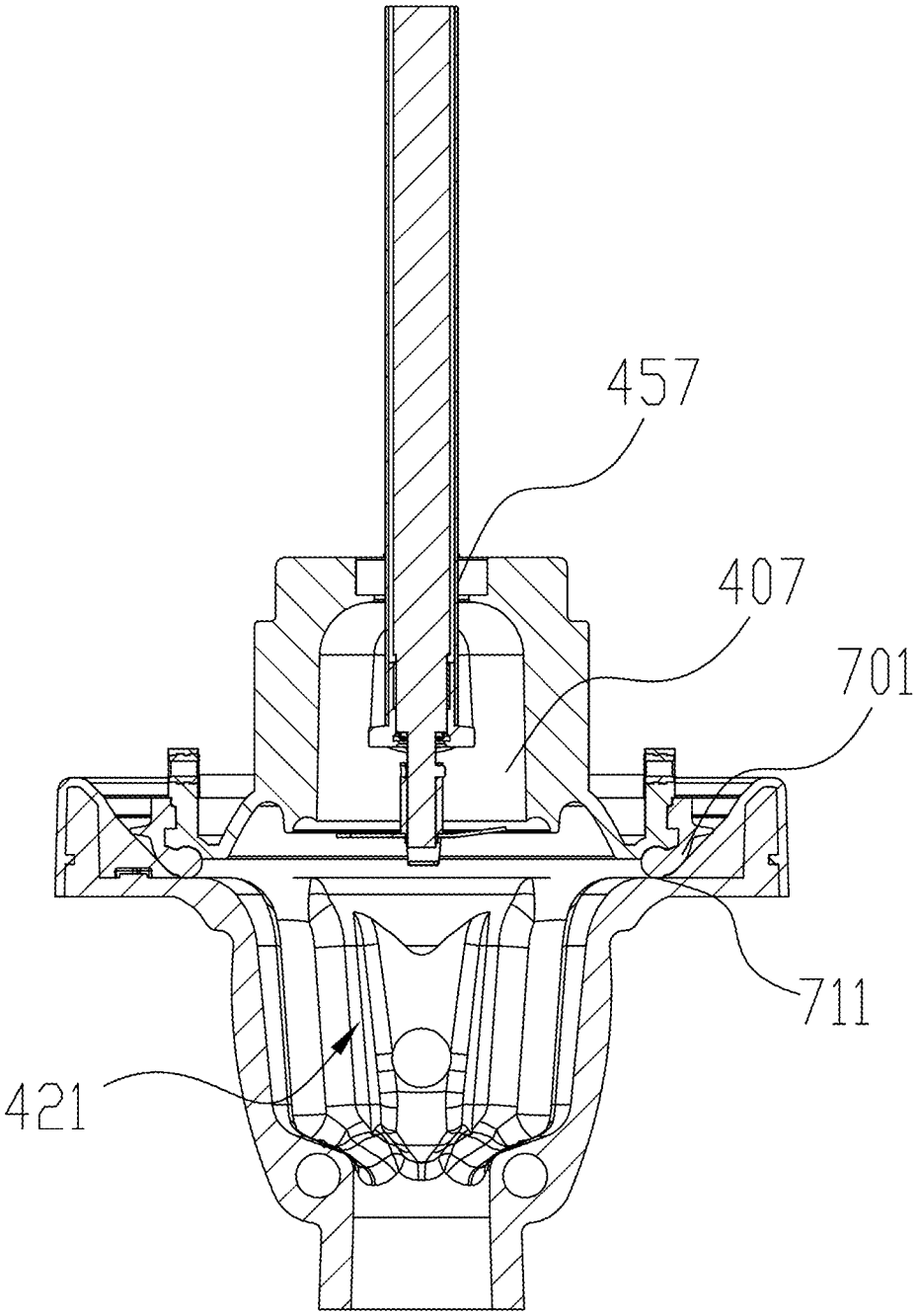
FIG. 9 provides a cut through which illustrates the blending head in place on the cleaning basin as will be done during a cleaning step.

Once the cup (200) is removed, the system may be cleaned. During cleaning, the blender mechanism will begin in its ready position as shown in FIG. 8. This is also the position where the system is ready to accept a cup (200). From FIG. 8, the blender bell (403) moves into its lowest position which is illustrated in FIG. 9. In this position the gasket (701) contacts the upper rim (711) of the basin (401). This seals the cavity (421) in the basin (401) together with the cavity (407) of the blending bell (403). Further, the blade assembly (501), blades (505), and a portion of the shaft (503) are sealed within a joint cavity formed of the cavity (407) and cavity (421). The gasket (701) can be used to counteract potential tolerances in the entire assembly and, thus, ensures a tight seal.

Depending on the embodiment, the blades (505) may be positioned within the cavity (407) or may be moved into cavity (421) for rinsing, cleaning, or sanitization. The latter lower position may be preferred to allow more of the shaft (403) to be within the joint cavity. Cleaning the shaft (503), however, will typically not be required as gasket (457) may be used to "wipe" the shaft (503) due to the presence of a high friction connection as the shaft (503) was retracted during FIGS. 5E and 5F. Further, descent of the blade assembly (501) may alternatively or additionally be used to position the blades (505) lower in the cavity (421) if a submersion of the blades (505) in a fluid is required as it allows for submersion with less fluid being used than if the blades (505) are positioned higher.

During cleaning, water (which may be from the same source as is used to supply water to the cup (200), or a different source) may first be used to rinse the inside cavity (407) of the blender bell (403), the cavity (421), the blade assembly (501), the blades (505), and/or the shaft (503). This rinsing may be followed by an automated cleaning cycle and, when required, a sanitization cycle. After a drying period (if required) for all cleaned and/or sanitized food contact areas, the blade assembly (501) will typically return to its position inside the blender bell (403) and the blending mechanism will return to the position of FIG. 8. As indicated above, this is the position where a cup (200) is ready to be accepted so the machine is ready to blend again.

In order to supply improved sanitation and safety and inhibit tampering with the material in the cup (100) prior to blending taking place, a removable seal (901) may be used to seal the orifice (301) in an embodiment. An embodiment of such a seal (901) is provided in FIGS. 10 and 11 where the seal (901) may be attached to the outer perimeter of the disk (117) beyond the petals (303). This attachment may be by any method including, but not limited to, press sealing, heat sealing, conduction sealing, induction sealing, or sonic welding. A heat shrink band or similar object may also or alternatively be used to cover the join between the lid (100) and cup (200) to inhibit the lid (100) from being separated from the cup (200) and returned without knowledge.

Figure 10:
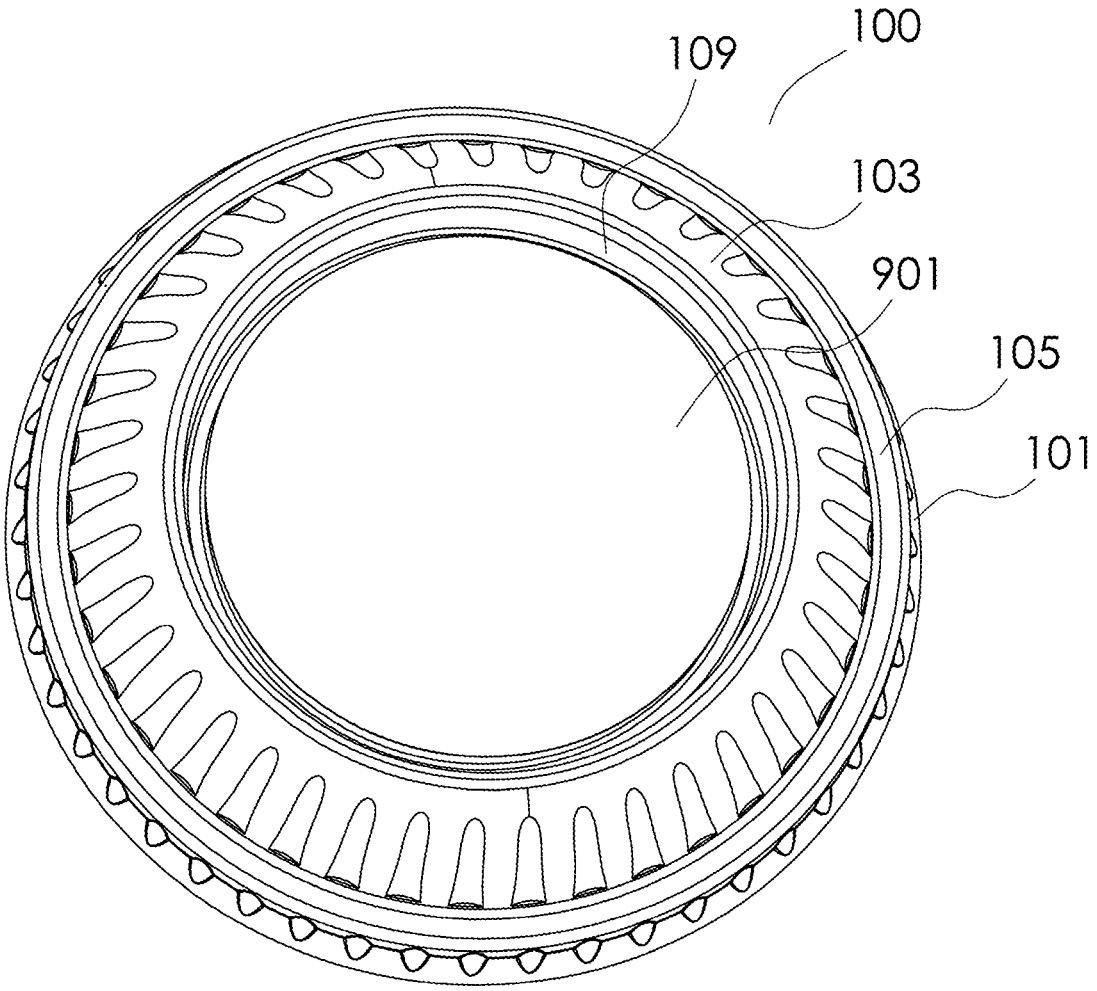
FIG. 10 shows a perspective view of an embodiment of a cup lid with an overseal in place.
Figure 11:
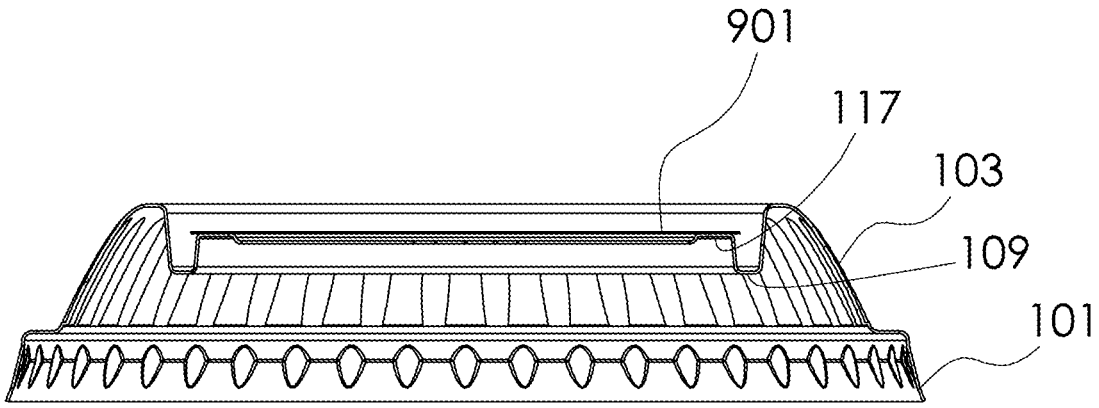
FIG. 11 shows a cut-through view of the embodiment of FIG. 10 along a diameter line.

In an embodiment that includes a removable seal (901), such as that of FIGS. 10 and 11, the seal (901) will typically be removed by an end customer who intends to utilize the cup (200), lid (100), and material (551) combination to make a drink. The presence of the hole (305), and orifice (301), if necessary, allows such a customer to also add to or modify the material (551) such as by adding different liquids and boosters to the material (551) prior to blending. However, this typically cannot be done without removal of the seal (901) so would only be done by, and with knowledge of, the consumer that is using the cup (200), lid (100), and material (551) combination.

In a still further embodiment, a seal may be used which does not cover the petals (303) but acts to replace them. Specifically, the orifice (301) may be covered by a seal such as, but not limited to, a foil seal that the blade assembly (501) can ready pierce and push out of the way as it descends. Similarly, the grooves (317) may not be fully cut, but may comprise points of weakness where the petals (303) are designed to separate as the blade assembly (501) pushes on them. The hole (305) may similarly comprise a segment or segments which are designed to remain attached to a petal, but pend out of the way of the hole (305) in a temporary or even permanent fashion.

The hole (305) will preferably be covered or filled after the blending process to avoid spillage if consumers take the drink on-the-go. As contemplated previously in conjunction with FIG. 4, this can be achieved by providing access to a straw (315) which may be of any type and can be placed in the hole (305). As indicated previously, the straw (315) will preferably have an outer diameter of generally the same size as the diameter of the hole (305) to provide a tight fit, while not resulting in the petals (303) being substantially bent. Bending the petals (303) with the straw (315) may result in the orifice being more open than is desired during drink consumption.

While the invention has been disclosed in conjunction with a description of certain embodiments, the detailed description is intended to be illustrative and should not be understood to limit the scope of the present disclosure. As would be understood by one of ordinary skill in the art, embodiments other than those described in detail herein are encompassed by the disclosed invention. Modifications and variations of the described embodiments may be made without departing from the spirit and scope of the invention.

It will further be understood that any of the ranges, values, properties, or characteristics given for any single component of the present disclosure can be used interchangeably with any ranges, values, properties, or characteristics given for any of the other components of the disclosure, where compatible, to form an embodiment having defined values for each of the components, as given herein throughout. Further, ranges provided for a genus or a category can also be applied to species within the genus or members of the category unless otherwise noted.

Finally, the qualifier "generally," and similar qualifiers as used in the present case, would be understood by one of ordinary skill in the art to accommodate recognizable attempts to conform a device to the qualified term, which may nevertheless fall short of doing so. This is because terms such as "circular" are purely geometric constructs and no real-world component is truly "circular" in the geometric sense. Variations from geometric and mathematical descriptions are unavoidable due to, among other things, manufacturing tolerances resulting in shape variations, defects and imperfections, non-uniform thermal expansion, and natural wear. Moreover, there exists for every object a level of magnification at which geometric and mathematical descriptors fail due to the nature of matter. One of ordinary skill would thus understand the term "generally" and relationships contemplated herein regardless of the inclusion of such qualifiers to include a range of variations from the literal geometric meaning of the term in view of these and other considerations.

The invention claimed is:

1. A lid for a drink cup, the lid comprising:

a main body including an outer ring configured to connect to said drink cup;

a central disk including a central orifice through said main body, the central orifice including a plurality of bendable petals which extend to the edge of a hole which is generally in the center of the central orifice;

an outer curved wall arranged between said central disk and said outer ring; and a generally circular groove connecting said central disk and said outer curved wall, said groove forming a channel between said central disk and said outer curved wall;

wherein said groove is configured to mate with a peak mounted on a base of a blender bell, said peak extending into said channel; and wherein when said blender bell is mated with said lid, a blade assembly of a blender may pass through said central orifice bending said petals.

2. The lid of claim 1, wherein when said blade assembly is within a volume of said drink cup, a shaft supporting said blade assembly extends through said hole and said petals are generally unbent.

3. The lid of claim 1, wherein blades on said blade assembly contact said petals to cause them to bend when said blade assembly is entering said drink cup.

4. The lid of claim 1, wherein said lid is generally in the form of a spherical segment of two bases.

5. The lid of claim 1, wherein said hole is configured to hold a straw and create a seal between said straw and said petals without said straw bending said petals.

6. The lid of claim 1, further comprising:

a seal attached to said central disk and covering said central orifice, said petals, and said hole.

7. The lid of claim 1, wherein blades on said blade assembly contact said petals to cause them to bend when said blade assembly is exiting said drink cup.

8. The lid of claim 7, wherein said contact between said blades and said petals causes said petals to push material on said blades off said blades.

9. The lid of claim 1, wherein said groove includes an undulating base.

10. The lid of claim 9, wherein said base of said blender bell includes an undulating ridge and said undulating base is complementary to said undulating ridge.

11. A blender and cup combination for blending within said cup, the combination comprising:

a cup;

a lid including an outer ring connected to a rim of said cup, said lid including:

a central disk including a central orifice through said central disk, the central orifice including a plurality of bendable petals which extend to the edge of a hole which is generally in the center of the central orifice;

an outer curved wall arranged between said central disk and said outer ring; and a generally circular groove connecting said central disk and said outer curved wall, said groove forming a channel between said central disk and said outer curved wall;

a blender bell including a base having a peak configured to mate with said groove, said peak extending into said channel; and a blade assembly mounted on a shaft which may move said blade assembly from a first position within said blender bell to a second position within said cup;

wherein when said blender bell is mated with said lid, movement of said blade assembly between said first position and said second position results in said blade assembly passing through said orifice bending said petals.

12. The combination of claim 11, wherein when said blade assembly is within said cup, said shaft extends through said hole and said petals are generally unbent.

13. The combination of claim 11, wherein blades on said blade assembly contact said petals to cause them to bend when said blade assembly is entering said cup.

14. The combination of claim 11, wherein said lid is generally in the form of a spherical segment of two bases.

15. The combination of claim 11, wherein said hole is configured to hold a straw and create a seal between said straw and said petals without said straw bending said petals.

16. The combination of claim 11, wherein blades on said blade assembly contact said petals to cause them to bend when said blade assembly is exiting said cup.

17. The combination of claim 16, wherein said contact between said blades and said petals causes said petals to push material on said blades off said blades.

18. The combination of claim 11, wherein said groove includes an undulating base.

19. The combination of claim 18, wherein said base of said blender bell includes an undulating ridge.

* * * * *